US007464681B2

(12) United States Patent
Rockwell et al.

(10) Patent No.: US 7,464,681 B2
(45) Date of Patent: Dec. 16, 2008

(54) ENGINE AND ENGINE CONTROL METHOD

(75) Inventors: Andrew Duncan Rockwell, East Peoria, IL (US); Michael Paul Withrow, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 326 days.

(21) Appl. No.: 11/362,813

(22) Filed: Feb. 28, 2006

(65) Prior Publication Data

US 2007/0199534 A1 Aug. 30, 2007

(51) Int. Cl.
*F02D 41/06* (2006.01)

(52) U.S. Cl. ..... 123/179.1; 701/104

(58) Field of Classification Search ..... 123/179.16, 123/701, 104, 113
See application file for complete search history.

(56) References Cited

U.S. PATENT DOCUMENTS

| | | | | |
|---|---|---|---|---|
| 4,433,665 | A | 2/1984 | Abe et al. | |
| 5,094,198 | A | 3/1992 | Trotta et al. | |
| 5,447,138 | A * | 9/1995 | Barnes | 123/446 |
| 5,655,506 | A | 8/1997 | Hollis | |
| 5,752,488 | A * | 5/1998 | Hattori et al. | 123/491 |
| 5,862,786 | A | 1/1999 | Fuchs et al. | |
| 5,890,467 | A * | 4/1999 | Romzek | 123/299 |
| 6,032,642 | A * | 3/2000 | Trumbower et al. | 123/299 |
| 6,058,912 | A * | 5/2000 | Rembold et al. | 123/516 |
| 6,098,584 | A * | 8/2000 | Ahner et al. | 123/179.3 |
| 6,138,645 | A | 10/2000 | Joppig et al. | |
| 6,148,258 | A * | 11/2000 | Boisvert et al. | 701/99 |
| 6,152,107 | A * | 11/2000 | Barnes et al. | 123/357 |
| 6,170,452 | B1 * | 1/2001 | Wisinski | 123/179.4 |
| 6,240,890 | B1 | 6/2001 | Abthoff et al. | |
| 6,240,896 | B1 * | 6/2001 | Ueda et al. | 123/299 |
| 6,305,348 | B1 * | 10/2001 | Grosmougin et al. | 123/299 |
| 6,327,900 | B1 | 12/2001 | McDonald et al. | |
| 6,367,456 | B1 * | 4/2002 | Barnes et al. | 123/501 |

(Continued)

FOREIGN PATENT DOCUMENTS

JP 2000220499 A2 8/2000

(Continued)

OTHER PUBLICATIONS

Toyota Motor Sales, U.S.A., Inc., "Temperature Sensors," printed from the internet on Oct. 25, 2005, pp. 1-7.

(Continued)

*Primary Examiner*—Stephen K. Cronin
*Assistant Examiner*—Arnold Castro
(74) *Attorney, Agent, or Firm*—Finnegan, Henderson, Farabow, Garrett & Dunner

(57) ABSTRACT

A method of operating an engine is provided. The engine may include a combustion chamber and a working member positioned adjacent the combustion chamber. The method may include providing a source of fuel for the engine. The method may also include starting the engine producing power by combusting fuel in the combustion chamber to drive the working member. Additionally, the method may include selectively controlling delivery of the fuel to the combustion chamber at least partially as a function of an air temperature in response to achieving at least one predetermined condition involving the air temperature. The air temperature may be at least one of an ambient air temperature and an intake air temperature.

19 Claims, 8 Drawing Sheets

U.S. PATENT DOCUMENTS

| | | | | |
|---|---|---|---|---|
| 6,518,763 | B2 | 2/2003 | Sollart | |
| 6,523,525 | B1 | 2/2003 | Hawkins | |
| 6,536,419 | B2 | 3/2003 | Roley | |
| 6,598,589 | B2 | 7/2003 | Frelund et al. | |
| 6,640,758 | B2 | 11/2003 | Ashida | |
| 6,688,101 | B2 | 2/2004 | Isobe et al. | |
| 6,931,865 | B1 | 8/2005 | Van Gilder et al. | |
| 6,990,969 | B2 | 1/2006 | Roth et al. | |
| 7,010,908 | B2 * | 3/2006 | Koyama et al. | 60/277 |
| 7,020,547 | B2 * | 3/2006 | Ogaki | 701/35 |
| 7,069,720 | B2 * | 7/2006 | Strayer et al. | 60/285 |
| 7,069,887 | B2 * | 7/2006 | Cornell et al. | 123/90.12 |
| 7,105,936 | B2 * | 9/2006 | Kubo | 290/32 |
| 7,201,127 | B2 * | 4/2007 | Rockwell et al. | 123/179.16 |
| 7,201,138 | B2 * | 4/2007 | Yamaguchi et al. | 123/305 |
| 7,240,480 | B1 * | 7/2007 | Brevick et al. | 60/280 |
| 7,240,663 | B2 * | 7/2007 | Lewis et al. | 123/321 |
| 7,275,510 | B2 * | 10/2007 | Mizutani | 123/179.4 |
| 7,277,791 | B2 * | 10/2007 | Petrosius et al. | 701/112 |
| 7,313,474 | B2 * | 12/2007 | Bowling et al. | 701/102 |
| 2003/0051692 | A1 * | 3/2003 | Mizutani | 123/179.15 |
| 2004/0255876 | A1 | 12/2004 | Hirooka | |
| 2005/0211227 | A1 * | 9/2005 | Mizutani | 123/491 |

FOREIGN PATENT DOCUMENTS

| | | | |
|---|---|---|---|
| JP | 2001082266 | A2 | 3/2001 |
| JP | 2001173490 | A2 | 6/2001 |
| JP | 2003172191 | A2 | 6/2003 |
| WO | WO 9906693 | A1 | 2/1999 |

OTHER PUBLICATIONS

Toyota Motor Sales, U.S.A., Inc., "Fuel Systems #2—Injection Duration Controls," printed from the internet on Oct. 25, 2005, pp. 1-7.

Singher, Phil, "All About D-Jetronic Fuel Injection," printed from the internet on Oct. 25, 2005, pp. 1-6, VClassics.

Chevy High Performance Magazine, "Sensor-Tivity Traning," printed from the internet on Oct. 25, 2005, pp. 1-3.

* cited by examiner

ENGINE AND ENGINE CONTROL METHOD

TECHNICAL FIELD

The present disclosure relates to engines and methods of controlling engines.

BACKGROUND

Many machines use engines to produce power for performing various tasks. Engines often produce power by delivering fuel and air to a combustion chamber and combusting the fuel with the air to drive a working member of the engine, such as a piston. Many factors affect whether and how completely the fuel combusts with the air in the combustion chamber. For example, temperatures in the combustion chamber and the manner in which fuel is delivered to the combustion chamber may affect whether combustion occurs successfully in the combustion chamber. Accordingly, many engines have engine controls that are configured to promote successful combustion by controlling fuel delivery to the combustion chamber dependent upon inputs from an engine temperature sensor, such as a coolant temperature sensor. However, in some circumstances, the signal from an engine temperature sensor alone may not be a good indication of temperatures in the combustion chamber of an engine.

U.S. Pat. No. 5,231,962 to Osuka et al. ("the '962 patent") discloses an engine that controls fuel delivery into the combustion chambers dependent upon air temperature and engine coolant temperature. The '962 patent discloses a diesel engine having a fuel injection control system with a controller that controls fuel injection into the combustion chambers. The '962 patent discloses that the fuel injection control system operates either in a "normal fuel injection mode" or a "split fuel injection mode." In the "normal fuel injection mode," the fuel injection control system causes a single, continuous fuel injection into each combustion chamber during each power cycle. In the "split fuel injection mode," the fuel injection control system causes multiple fuel injections into each combustion chamber during each power cycle. The '962 patent discloses that the controller determines whether to operate in the "normal fuel injection mode" or the "split fuel injection mode" based upon the temperature of the engine's coolant. Additionally, the '962 patent discloses that intake air temperature may also be a parameter that the controller uses in controlling the "split fuel injection mode."

Although the '962 patent discloses controlling fuel delivery into the combustion chambers of the engine dependent upon intake air temperature in addition to engine coolant temperature, certain disadvantages persist. For example, the '962 patent provides no details regarding when or how the fuel injection control system would utilize intake air temperature as a parameter in controlling the "split fuel injection mode." The engine controls may realize performance benefits from using the intake air temperature as a parameter in controlling fuel delivery to the combustion chambers only if the engine controls factor in the intake air temperature under appropriate circumstances and in appropriate manners.

The engine and operating methods of the present disclosure solve one or more of the problems set forth above.

SUMMARY OF THE INVENTION

One disclosed embodiment relates to a method of operating an engine. The engine may include a combustion chamber and a working member positioned adjacent the combustion chamber. The method may include providing a source of fuel for the engine. The method may also include starting the engine producing power by combusting fuel in the combustion chamber to drive the working member. Additionally, the method may include selectively controlling delivery of the fuel to the combustion chamber at least partially as a function of an air temperature in response to achieving at least one predetermined condition involving the air temperature. The air temperature may be at least one of an ambient air temperature and an intake air temperature.

Another disclosed embodiment relates to an engine having a combustion chamber and a working member positioned adjacent the combustion chamber. The engine may further include engine controls operable to cause the engine to produce power by combusting fuel in the combustion chamber to drive the working member. The engine controls may also be operable to, when starting the engine producing power, in response to achieving at least one first predetermined condition involving an air temperature, execute a cold-start algorithm for controlling fuel delivery to the combustion chamber. The air temperature may be at least one of an ambient air temperature and an intake air temperature. Executing the cold-start algorithm for controlling fuel delivery to the combustion chamber may include delivering fuel to the combustion chamber in a manner to compensate for cold conditions and promote successful combustion.

A further disclosed embodiment relates to an engine that includes a combustion chamber and a working member positioned adjacent the combustion chamber. The engine may further include engine controls operable to cause the engine to produce power by combusting fuel with air in the combustion chamber to drive the working member. The engine controls may also be operable to, in at least some circumstances, control fuel delivery to the combustion chamber at least partially as a function of an air temperature, the air temperature being at least one of an ambient air temperature and an intake air temperature. The engine controls may also be operable to, in at least some circumstances, control fuel delivery to the combustion chamber at least partially as a function of an engine temperature. Additionally, the engine controls may be operable to, while causing the engine to produce power, change the relative significance of the air temperature and the engine temperature as factors in controlling fuel delivery to the combustion chamber.

DETAILED DESCRIPTION

Figure 1:
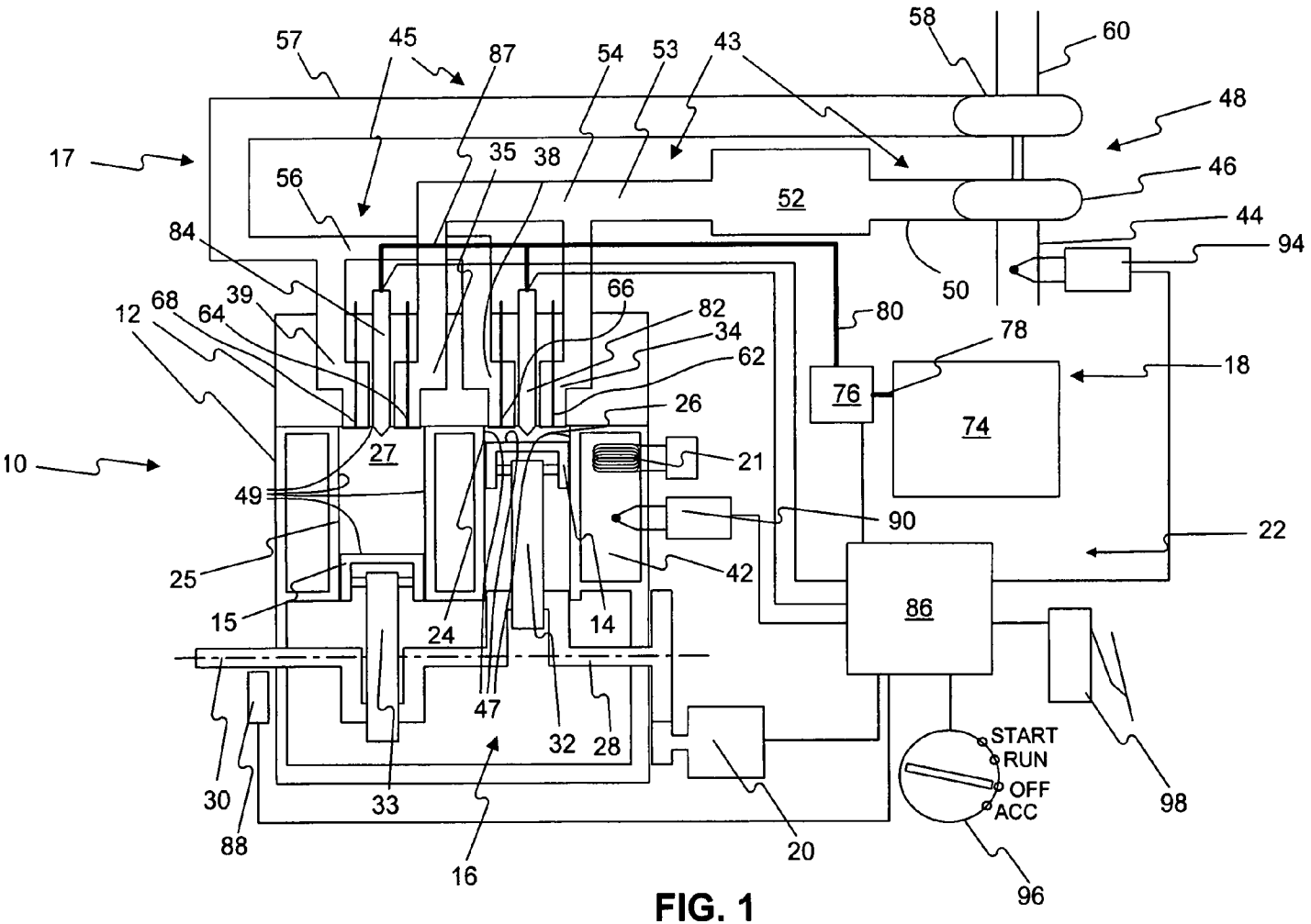
FIG. 1 is a schematic illustration of one embodiment of an engine according to the present disclosure with an aspiration system and a fuel system connected to the engine.
Figure 2A:
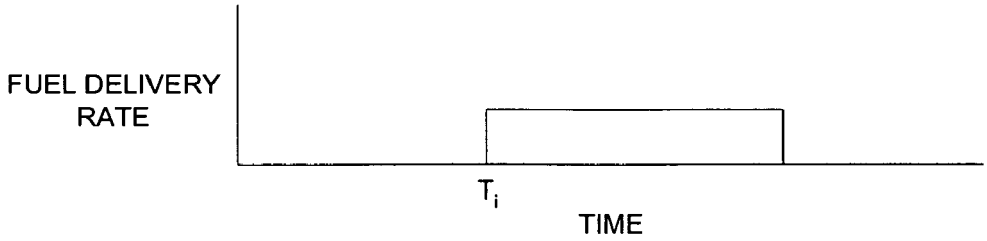
FIG. 2A is a graphical illustration of one manner of delivering fuel into a combustion chamber of an engine.
Figure 2B:
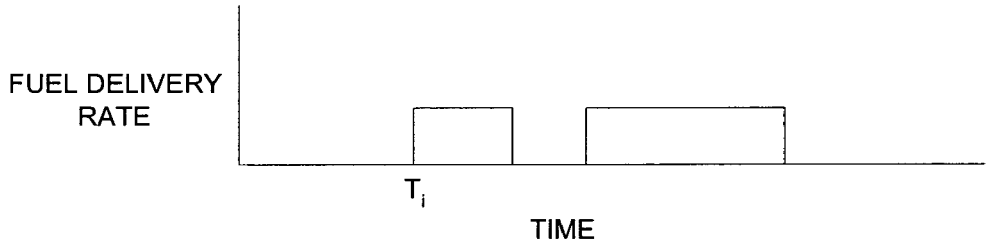
FIG. 2B is a graphical illustration of another manner of delivering fuel into a combustion chamber of an engine.
Figure 2C:
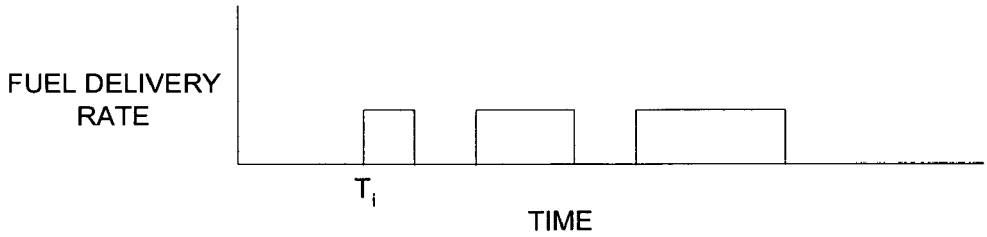
FIG. 2C is a graphical illustration of another manner of delivering fuel into a combustion chamber of an engine.
Figure 3A:
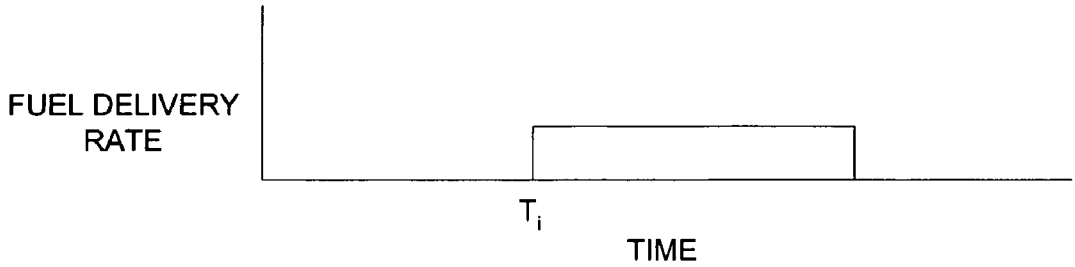
FIG. 3A is a graphical illustration of another manner of delivering fuel into a combustion chamber of an engine.
Figure 3B:
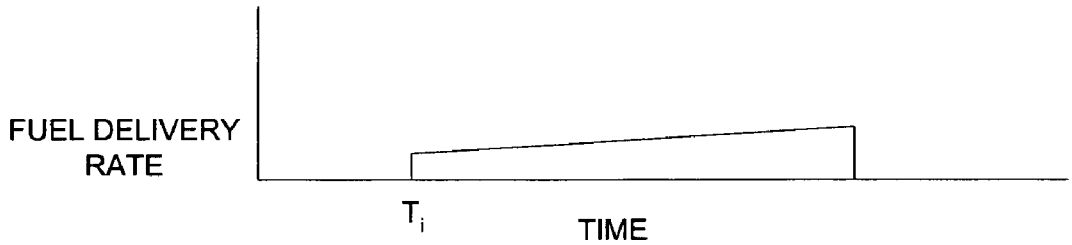
FIG. 3B is a graphical illustration of another manner of delivering fuel into a combustion chamber of an engine.
Figure 3C:
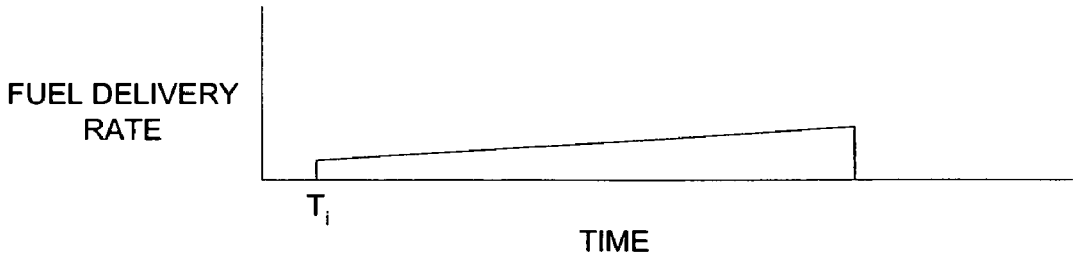
FIG. 3C is a graphical illustration of another manner of delivering fuel into a combustion chamber of an engine.
Figure 4A:
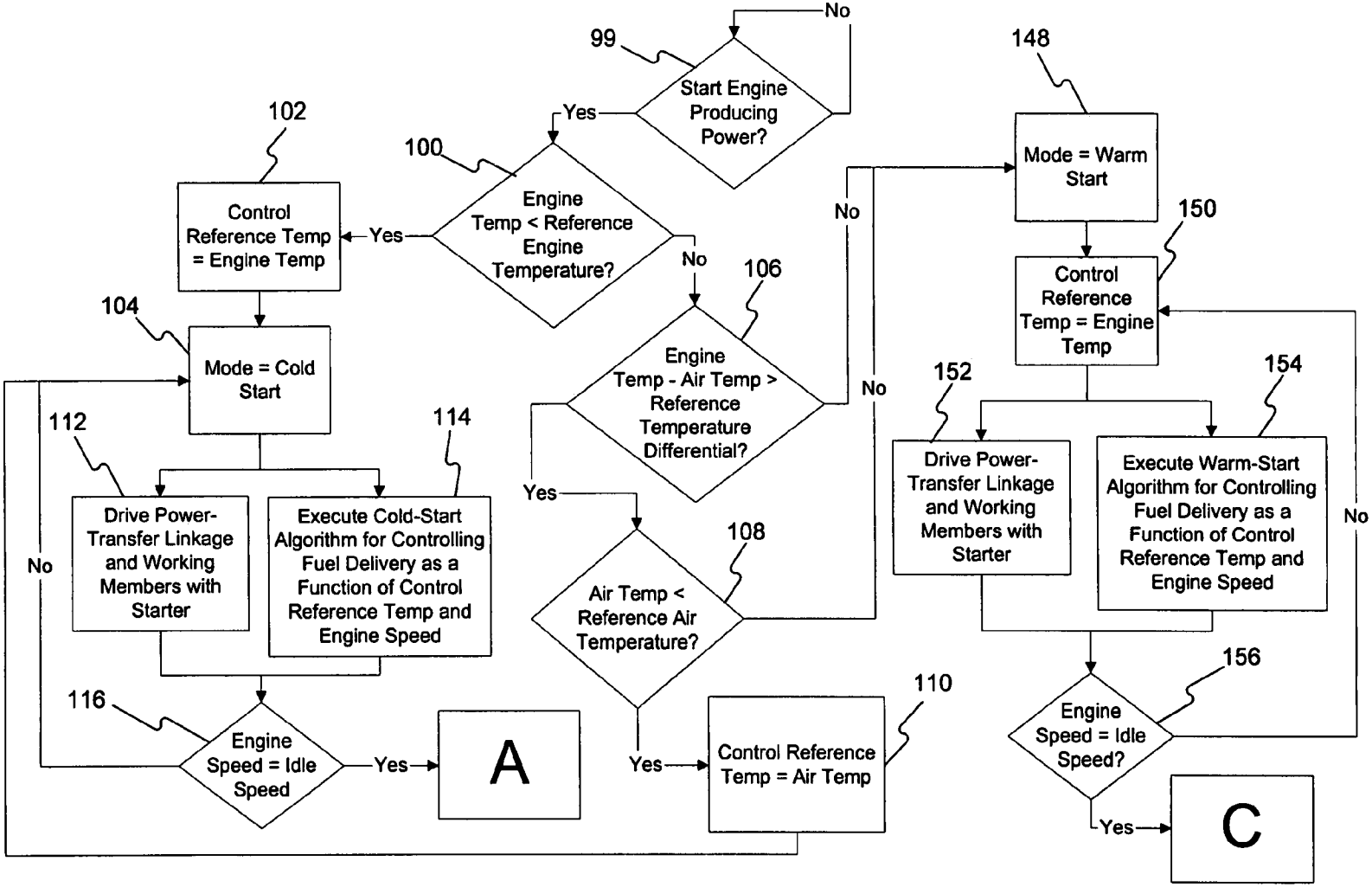
FIG. 4A is a first portion of a flow chart illustrating a method for operating an engine according to one embodiment of the present disclosure.
Figure 4B:
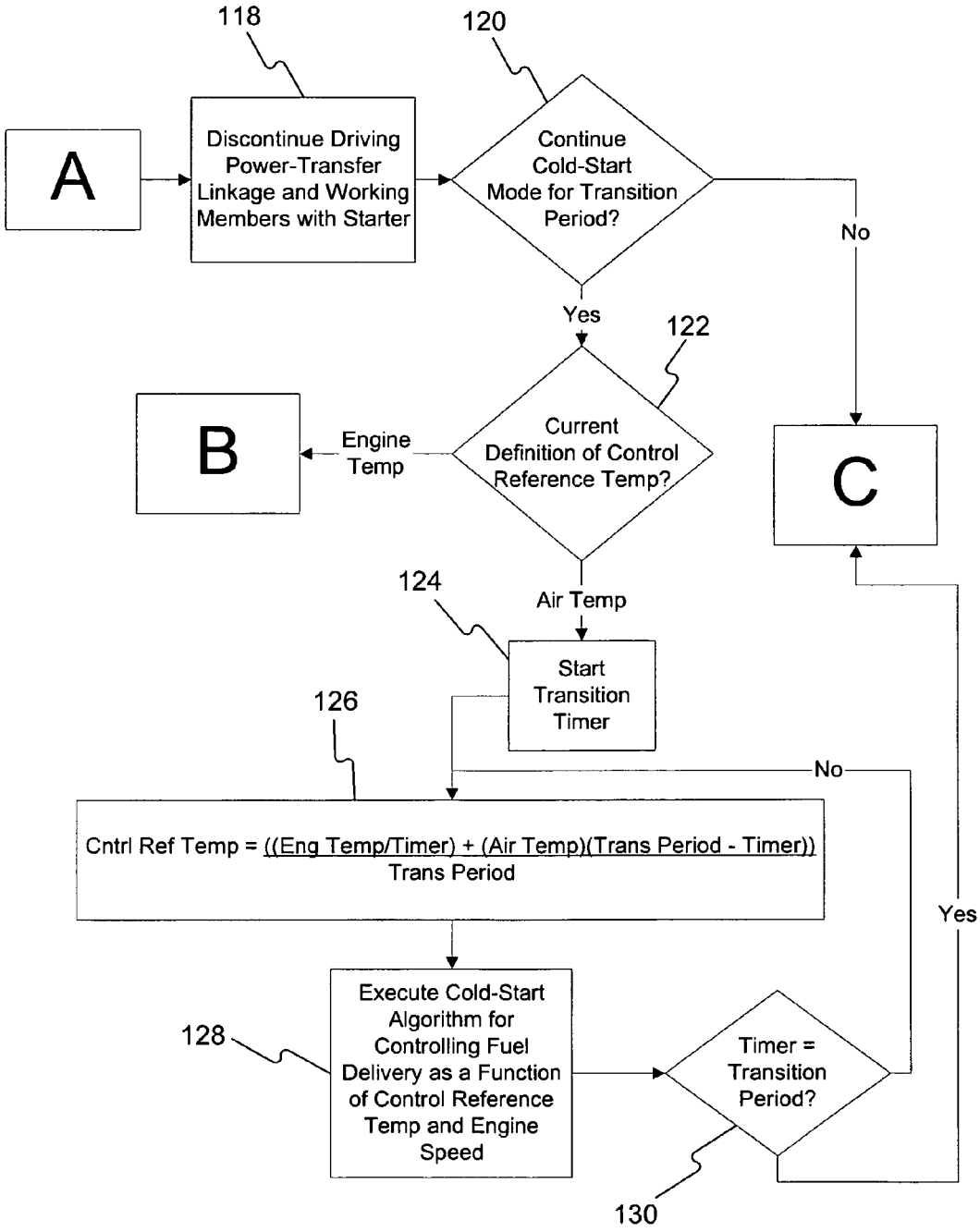
FIG. 4B is a second portion of the flow chart of FIG. 4A.
Figure 4C:
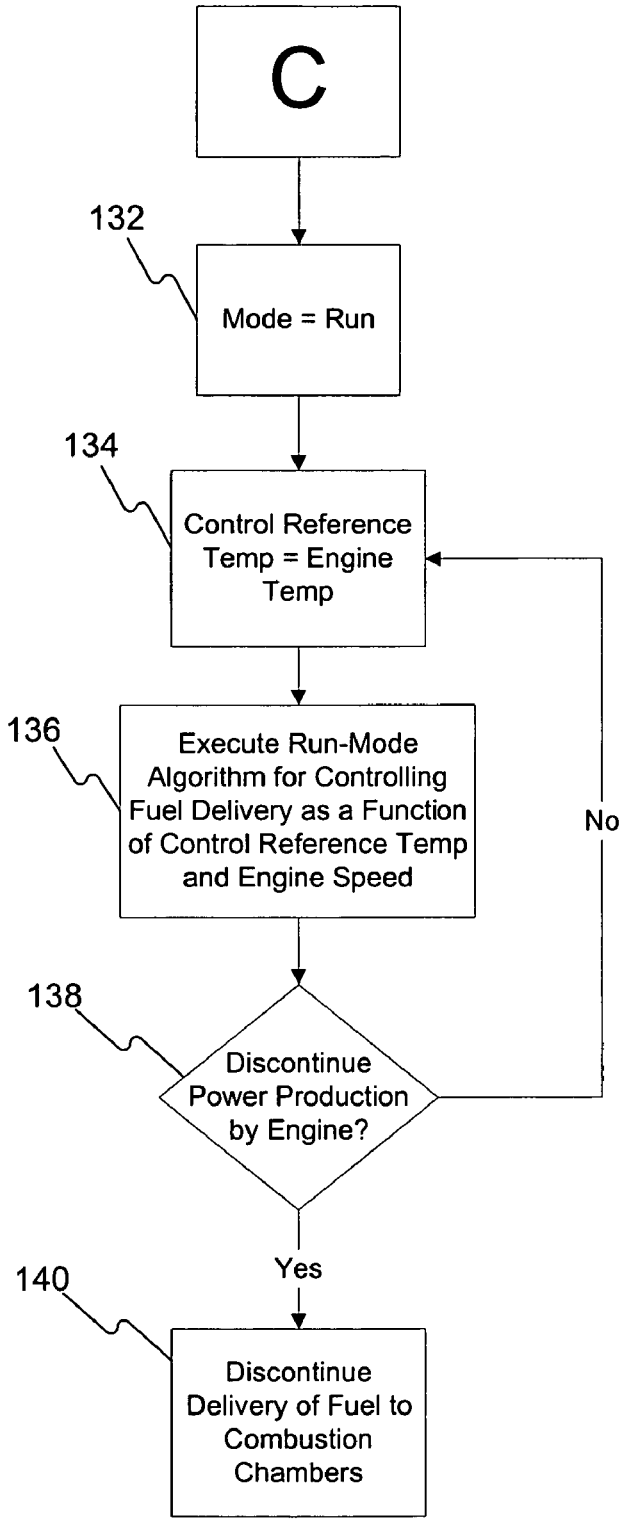
FIG. 4C is a third portion of the flow chart of FIG. 4A.
Figure 4D:
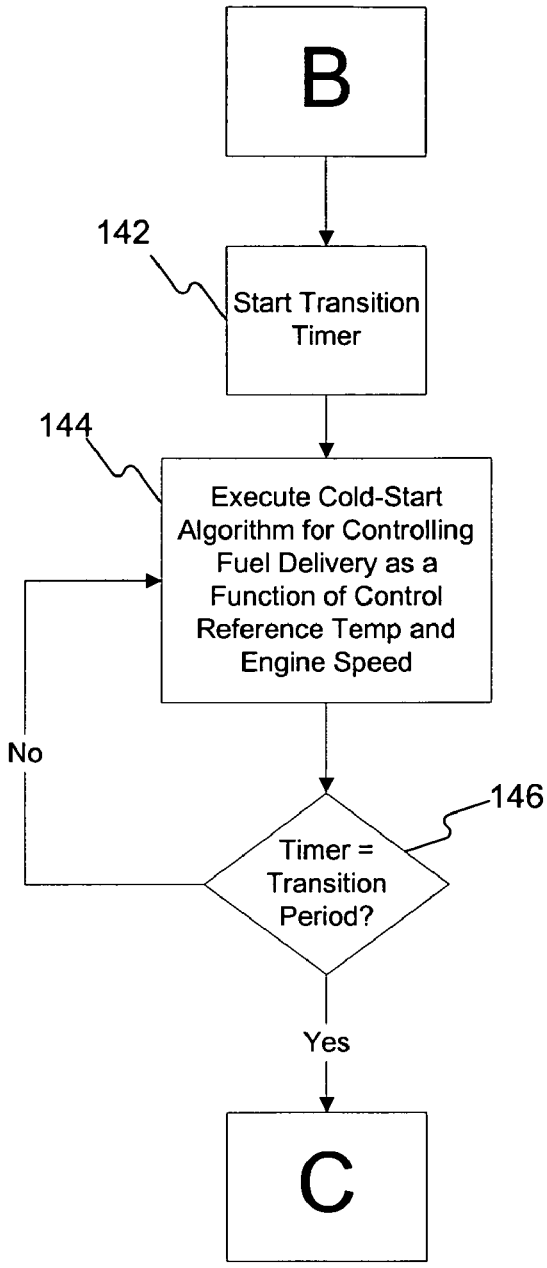
FIG. 4D is a fourth portion of the flow chart of FIG. 4A.

FIG. 1 illustrates one embodiment of an engine 10 according to the present disclosure, an aspiration system 17 for engine 10, and a fuel system 18 for engine 10. Engine 10 may include a housing 12, working members 14, 15, a power-transfer linkage 16, a starter 20, an engine heater 21, and engine controls 22. In some embodiments, engine 10 may be a compression-ignition engine.

Working members 14, 15 and power-transfer linkage 16 may be supported at least partially within housing 12. As FIG. 1 shows, in some embodiments, working members 14, 15 may be pistons disposed in channels 24, 25 of housing 12. Additionally, housing 12 may support a crank member 28 of power-transfer linkage 16 in such a manner that crank member 28 may rotate about an axis 30. In addition to crank member 28, power-transfer linkage 16 may include connecting members 32, 33 connecting working members 14, 15 and crank member 28 in such a manner that sliding of working members 14, 15 in channels 24, 25 causes rotation of crank member 28 about axis 30 and vice versa.

Housing 12 may also include various other features for facilitating operation of engine 10. Housing 12 may include a combustion chamber 26, 27 at an end of each channel 24, 25. Each combustion chamber 26, 27 may be surrounded by combustion chamber surfaces 47, 49 on the ends and sides of channels 24, 25 and on working members 14, 15. Additionally, housing 12 may include intake passages 34, 35 and exhaust passages 38, 39 connected to combustion chambers 26, 27, respectively. Housing 12 may also include a cooling jacket 42 with liquid coolant disposed therein. As FIG. 1 shows, housing 12 may be constructed of multiple components fastened together. Alternatively, housing 12 may be constructed as one piece.

The general configuration of engine 10 is not limited to that shown in FIG. 1. In addition to working members 14, 15, engine 10 may include other working members and associated components and provisions. Alternatively, engine 10 may omit working member 15 and the associated components and provisions. Additionally, engine 10 may be a type of engine having a significantly different configuration of housing 12, working member 14, and power-transfer linkage 16. For example, in some embodiments, engine 10 may be a Wankel-type rotary engine with working member 14 being a rotor, a sliding-vane-type engine with working member 14 being one of the sliding vanes, or any other type of engine having a working member 14 configured to be moved by combustion gases. Additionally, in some embodiments, engine 10 may omit power-transfer linkage 16 and transfer power from working member 14 to other components directly or through means other than a mechanical linkage.

Aspiration system 17 may include an air intake system 43 for directing air to combustion chambers 26, 27 and an exhaust system 45 for directing combustion gases from combustion chambers 26, 27. Air intake system 43 may include a passage 44, a compressor unit 46 of a turbocharger 48, a passage 50, a charge air cooler 52, a passage 53, a manifold 54, and intake passages 34, 35. Exhaust system 45 may include exhaust passages 38, 39, a manifold 56, a passage 57, a turbine unit 58 of turbocharger 48, and a passage 60.

In addition to air intake system 43 and exhaust system 45, aspiration system 17 may include various components for controlling the flow of air and combustion gases to and from combustion chambers 26, 27. For example, aspiration system 17 may include intake valves 62, 64 for controlling flow between air intake system 43 and combustion chambers 26, 27 and exhaust valves 66, 68 for controlling flow between combustion chambers 26, 27 and exhaust system 45. Aspiration system 17 may also include actuators (not shown) for opening and closing valves 62, 64, 66, and 68, such as mechanical valve trains.

Aspiration system 17 is not limited to the configuration shown in FIG. 1. For example, air intake system 43 and exhaust system 45 may omit one or more of the components shown in FIG. 1 and/or include components not shown in FIG. 1, such as one or more filters, throttles, additional turbochargers, gas-treatment units, and/or mufflers. Additionally, valves 62, 64, 66, and 68 may have different configurations than shown in FIG. 1. Furthermore, in some embodiments, such as embodiments where engine 10 is a Wankel-type engine, aspiration system 17 may omit valves 62, 64, 66, 68.

Fuel system 18 may be configured to deliver fuel into combustion chambers 26, 27 either directly or through one or more portions of air intake system 43. Fuel system 18 may include a fuel tank 74, a fuel pump 76, fuel lines 78, 80, and fuel-metering devices 82, 84. In some embodiments, fuel-metering devices 82, 84 may be fuel injectors. Additionally, in some embodiments where fuel-metering devices 82, 84 are fuel injectors, fuel-metering devices 82, 84 may connect to fuel line 80 and fuel pump 76 through a common fuel rail 87.

Fuel system 18 is not limited to the configuration shown in FIG. 1. For example, rather than having a common-rail configuration, fuel system 18 may have a unit injection configuration. Additionally, in embodiments where fuel system 18 is configured to deliver fuel into air intake system 43 for delivery to combustion chambers 26, 27, fuel system 18 may omit one of fuel-metering devices 82, 84. Furthermore, in some embodiments, one or both of fuel-metering devices 82, 84 may be a type of device other than a fuel injector, such as a carburetor.

Starter 20 may be configured to drive power-transfer linkage 16 and working members 14, 15 to enable engine controls 22 to start engine 10 producing power. Starter 20 may include various types of power sources for driving power-transfer linkage 16 and working members 14, 15, including, but not limited to, an electric motor, a fluid-powered motor, and an engine.

Engine heater 21 may include any type of device operable to heat engine 10, such as an electric heating element and/or a fuel burner. In some embodiments, engine heater 21 may be mounted at a distance from combustion chambers 26, 27. For example, as FIG. 1 shows, engine heater 21 may be mounted within cooling jacket 42 so as to heat engine 10 by heating the coolant therein. Alternatively, engine heater 21 may be mounted in various other locations, such as on exterior or interior surfaces of housing 12.

Engine controls 22 may be any collection of components operable to control the operation of engine 10. Engine controls 22 may include valves 62, 64, 66, 68, any actuators for opening and closing valves 62, 64, 66, 68, fuel pump 76, and fuel-metering devices 82, 84. Additionally, engine controls 22 may include various information-gathering and processing systems. For example, engine controls 22 may include a controller 86 operatively connected to a speed/position sensor 88, an engine temperature sensor 90, an air temperature sensor 94, an engine mode selector 96, and a throttle input 98. Speed/position sensor 88 may be configured to provide a signal relating to the speed and/or position of crank member 28 to controller 86. Engine temperature sensor 90 may be operable to sense a temperature of engine 10 and provide controller 86 with a signal relating to the sensed temperature. For example, as FIG. 1 shows, engine temperature sensor 90 may be operable to sense the temperature of the liquid coolant in cooling jacket 42 and provide controller 86 with a signal relating thereto.

Air temperature sensor 94 may be operable to provide controller 86 with a signal relating to the temperature of engine intake air in air intake system 43 and/or the temperature of ambient air outside air intake system 43. As FIG. 1 shows, air temperature sensor 94 may be arranged to sense the temperature of air in passage 44. By sensing the air temperature inside passage 44, air temperature sensor may provide a signal relating to both the intake air temperature and the ambient air temperature. Dependent upon the configuration of air intake system 43, air temperature sensor 94 may be positioned in various other components of air intake system 43 wherein the intake air temperature is approximately equal to ambient air temperature, such that air temperature sensor 94 may provide a signal relating to both the intake air temperature and the ambient air temperature.

Alternatively, air temperature sensor 94 may provide a signal related to only one of ambient air temperature and intake air temperature. In some embodiments, air temperature sensor 94 may be positioned within a component of air intake system 43 wherein the intake air temperature may not be equal to ambient air temperature. For example, air temperature sensor 94 may be positioned within passage 50, where the intake air may have a higher than ambient temperature from compression by compressor unit 46. In such a case, air temperature sensor 94 may provide a signal that relates to the intake air temperature, but not the ambient air temperature. Additionally, in some embodiments, air temperature sensor 94 may be positioned outside air intake system 43, such that air temperature sensor 94 provides a signal relating only to the ambient air temperature.

Engine mode selector 96 and throttle input 98 may be configured to transmit operator inputs to controller 86 and/or other components of engine controls 22. Engine mode selector 96 may be configured to allow an operator to signal controller 86 and/or other components of engine controls 22 when to start and stop engine 10 producing power. Throttle input 98 may be configured to transmit to controller 86 and/or other components of engine controls 22 operator inputs relating to the desired power output and/or operating speed of engine 10.

Controller 86 may include one or more processors (not shown) and one or more memory devices (not shown). Controller 86 may be operatively connected to various components of fuel system 18 so that controller 86 may partially or fully control how and/or when fuel system 18 delivers fuel to combustion chambers 26, 27. For example, as FIG. 1 shows, controller 86 may be operatively connected to fuel pump 76 so that controller 86 can adjust the rate and/or pressure at which fuel pump 76 delivers fuel to common fuel rail 87. Additionally, controller 86 may be operatively connected to each fuel-metering device 82, 84 so that controller 86 may directly control when, at what rate, and/or for how long each fuel-metering device 82, 84 delivers fuel into a respective combustion chamber 26, 27. Furthermore, controller 86 may be operatively connected to starter 20 so that controller 86 may control whether starter 20 drives power-transfer linkage 16 and working members 14, 15.

Engine controls 22 are not limited to the configuration shown in FIG. 1. For example, in addition to, or in place of, being operable to control fuel pump 76 and fuel-metering devices 82, 84, controller 86 may be operable to control other components of fuel system 18. Additionally, in place of controller 86, speed/position sensor 88, engine temperature sensor 90, and/or air temperature sensor 94, engine controls 22 may include various other electrical, mechanical, hydraulic, pneumatic and/or other types of control components for controlling engine 10 as described herein below. Furthermore, engine controls 22 may include various other components or systems, such as a spark-ignition system in embodiments where engine 10 is a spark-ignition engine.

INDUSTRIAL APPLICABILITY

Engine 10 may have application wherever power is required to perform one or more tasks. Engine 10 may produce power by combusting fuel with air in combustion chambers 26, 27 to drive working members 14, 15, power-transfer linkage 16, and any power loads connected to power-transfer linkage 16. In some embodiments, engine controls 22 may cause engine 10 to produce power by repeatedly executing a power cycle, such as a two-stage or four-stage compression-ignition or spark-ignition power cycle, in each combustion chamber 26, 27. When starting engine 10 producing power, engine controls 22 may drive power-transfer linkage 16 and working members 14, 15 with starter 20 until engine 10 reaches a stable operating speed.

Various operating conditions of engine 10 may affect performance of each power cycle in combustion chambers 26, 27. For example, the temperature of the air delivered into a combustion chamber 26, 27 and the temperatures of combustion chamber surfaces 47, 49 may affect how easily combustion may be initiated in the combustion chamber 26, 27. Generally, the lower these temperatures are, the less likely it is that fuel introduced into the combustion chamber 26, 27 will combust successfully. Additionally, engine speed may affect how readily and completely fuel combusts in combustion chambers 26, 27. For example, in some embodiments, when working members 14, 15 are moving relatively slowly, conditions in combustion chambers 26, 27 may be less conducive to combustion than when working members 14, 15 are moving at higher speeds. This may complicate certain phases of operation, such as starting engine 10 producing power, when engine speed may be relatively low.

Additionally, various aspects of how engine controls 22 cause each power cycle affect the performance of each power cycle. For example, the way that engine controls 22 deliver fuel into a combustion chamber 26, 27 during a power cycle may affect the performance of that power cycle. The quantity of fuel delivered during a power cycle, the initial timing of fuel delivery during a power cycle, the time pattern of fuel delivery during a power cycle, and the force, velocity, and pressure of fuel delivery are all factors that may affect the performance of the power cycle in one or more embodiments and/or circumstances. Within this disclosure, the "initial timing" of fuel delivery during a power cycle in a combustion chamber is the time during the power cycle at which engine controls 22 begin delivering fuel into the combustion chamber. Additionally, the "time pattern" of fuel delivery during a power cycle in a combustion chamber 26, 27 is the manner in which the rate of fuel delivery into the combustion chamber 26, 27 varies over time subsequent to the beginning of fuel delivery.

FIGS. 2A-2C and FIGS. 3A-3C provide graphical examples of some different approaches that engine controls 22 may implement when delivering fuel into a combustion chamber 26, 27 during a power cycle. Each of the fuel delivery approaches illustrated in FIGS. 2A-2C and 3A-3C includes a different time pattern of fuel delivery. The time patterns shown in FIGS. 2A-2C differ from one another in that they have different numbers and durations of discrete fuel deliveries, with different delay times between those discrete fuel deliveries. The time patterns shown in FIGS. 3A-3C differ from one another in that the rate of fuel delivery varies in a different manner over the course of a single fuel delivery event. The time pattern of fuel delivery shown in each of FIGS. 2B, 2C, 3B, and 3C is more gradual than the time pattern of fuel delivery shown in the preceding figure. Additionally, the fuel delivery approach illustrated in each of FIGS. 2B, 2C, 3B, and 3C includes an earlier initial timing $T_i$ than the approach illustrated in the preceding figure.

In some embodiments, such as some embodiments where engine 10 is a compression-ignition engine, a gradual time pattern of fuel delivery during a power cycle may promote successful combustion in cold conditions and/or when working members 14, 15 are moving slowly. In embodiments where engine 10 utilizes compression ignition, if the temperatures in a combustion chamber 26, 27 are low, the air in the combustion chamber 26, 27 may lack sufficient heat to fully combust a large, concise fuel delivery, such as the one shown in FIG. 2A or the one shown in FIG. 3A. However, if engine controls 22 deliver the fuel in a more gradual manner, as shown in FIGS. 2B, 2C, 3B, and 3C, the air in the combustion chamber 26, 27 may have enough heat to combust the small amount of fuel initially delivered. Combustion of the fuel initially delivered may generate sufficient heat to allow combustion of fuel delivered subsequently, which may generate sufficient heat to allow combustion of fuel delivered subsequent to that, and so on until all of the delivered fuel has been combusted. Additionally, early initial timing of fuel delivery during a power cycle may allow both gradual delivery of fuel into a combustion chamber 26, 27 and timely completion of fuel delivery into the combustion chamber 26, 27 during a power cycle.

In order to achieve desirable operation of engine 10, engine controls 22 may implement various methods of controlling engine 10 dependent upon engine temperature, air temperature, engine speed, and/or other operating conditions of engine 10. FIGS. 4A-4D illustrate one such method. Initially, when engine 10 is inactive, controller 86 may determine whether to start engine 10 producing power. (step 99) Controller 86 may determine to start engine 10 producing power in response to various events, such as an operator utilizing engine mode selector 96 to signal controller 86 to start engine 10 producing power.

After determining to start engine 10 producing power, controller 86 may determine whether the signal generated by engine temperature sensor 90 indicates that the temperature of engine 10 is below a reference engine temperature, such as 10 degrees Celsius. (step 100) The engine temperature being below the reference engine temperature may indicate that combustion chamber surfaces 47, 49 may be relatively cold. Additionally, the engine temperature being below the reference engine temperature may indicate that the air temperature is relatively low also, as the air temperature is unlikely to be substantially higher than the engine temperature. If the engine temperature is below the reference engine temperature, controller 86 may define a control reference temperature to be equal to the engine temperature, as indicated by engine temperature sensor 90. (step 102) Additionally, controller 86 may cause engine controls 22 to be in a cold-start mode of operation in response to the signal from engine temperature sensor 90 indicating that the temperature of engine 10 is below the reference engine temperature. (step 104)

If the signal from engine temperature sensor 90 indicates that the temperature of engine 10 is not below the reference engine temperature, controller 86 may make additional determinations before defining the control reference temperature or selecting the operating mode of engine controls 22. Controller 86 may determine whether the signals generated by engine temperature sensor 90 and air temperature sensor 94 indicate that the engine temperature exceeds the air temperature by more than a reference temperature differential, such as 10 degrees Celsius. (step 106) If the indicated engine temperature exceeds the indicated air temperature by more than the reference temperature differential, the indicated engine temperature may not be a good source of information about conditions in combustion chambers 26, 27. When there is a substantial difference between the indicated temperatures, engine temperature sensor 90 may not provide an approximate indication of the temperature of air that will be delivered to combustion chambers 26, 27.

Additionally, if there is a substantial difference between the indicated engine temperature and the indicated air temperature, the relatively high indicated engine temperature may not be indicative of correspondingly high temperatures of combustion chamber surfaces 47, 49. When engine 10 is not producing power, engine temperature sensor 90 may be receiving heat in unknown proportions from various sources, such as the atmosphere, engine heater 21, and/or residual heat in components of engine 10 from previous power production. If the relatively high indicated engine temperature is the result of a source of heat other than previous power production, such as engine heater 21, combustion chamber surfaces 47, 49 may have relatively low temperatures, notwithstanding the relatively high indicated engine temperature.

Accordingly, if the indicated engine temperature exceeds the indicated air temperature by more than the reference temperature differential, controller 86 may use the signal from air temperature sensor 94 to determine whether to operate in cold-start mode. For example, controller 86 may determine whether the signal from air temperature sensor 94 indicates an air temperature less than a reference air temperature (step 108), such as 10 degrees Celsius. If so, controller 86 may define the control reference temperature to be the temperature indicated by air temperature sensor 94 (step 110) and cause engine controls 22 to be in cold-start mode (step 104).

After controller 86 defines the control reference temperature and causes engine controls 22 to be in cold-start mode, controller 86 may operate engine controls 22 to cause engine 10 to start producing power. Controller 86 may cause starter 20 to drive power-transfer linkage 16 and working members 14, 15. (step 112) Simultaneously, controller 86 may cause engine controls 22 to execute a cold-start algorithm for controlling fuel delivery to combustion chambers 26, 27 as a function of the control reference temperature and engine speed (step 114).

Executing the cold-start algorithm may include controlling fuel delivery as a function of the control reference temperature and engine speed in a manner to compensate for the cold condition indicated by the control reference temperature to promote successful combustion in combustion chambers 26, 27. In some embodiments, controller 86 may control the initial timing and the time pattern of fuel delivering into each combustion chamber 26, 27 during each power cycle as a function of the control reference temperature and engine speed. Engine controls 22 may employ such a control method in various embodiments of engine 10, including, but not limited to, embodiments where engine 10 is a compression-ignition engine and embodiments where engine 10 is a direct-injection spark-ignition engine. In some embodiments, the cold-start algorithm may be such that the lower the control reference temperature and the engine speed are, the earlier the initial timing will be during each power cycle and the more gradual the time pattern of fuel delivery will be during each power cycle. One embodiment of such a cold-start algorithm for controlling fuel delivery to combustion chambers 26, 27 is discussed in detail below in association with FIG. 5.

The cold-start algorithm may also include controlling various other aspects of the operation of fuel system 18 as a function of the control reference temperature and engine speed to compensate for cold conditions and promote successful combustion. For example, controller 86 may control the fuel pressure in common fuel rail 87 as a function of the control reference temperature and engine speed. Additionally, in some embodiments, engine controls 22 may control the quantity of fuel delivered to each combustion chamber 26, 27 during each power cycle as a function of the control reference temperature and engine speed. For example, in some embodiments where engine 10 is a spark-ignition engine, executing the cold-start algorithm may include delivering fuel to combustion chambers 26, 27 in quantities that cause a rich air/fuel ratio in combustion chambers 26, 27 so as to promote successful combustion.

When executing the cold-start algorithm, engine controls 22 may control fuel delivery as a function of various other factors in addition to the control reference temperature and engine speed. Engine controls 22 may control fuel delivery as a function of inputs from throttle input 98 and/or various other operator-input devices, inputs from various controllers other than controller 86, and/or inputs from other sensors in addition to engine temperature sensor 90, air temperature sensor 94, and speed/position sensor 88 Additionally, in some embodiments, one or more aspects of how engine controls 22 execute the cold-start algorithm may depend upon whether engine controls 22 are executing the cold-start algorithm in response to the indicated engine temperature being low or in response to conditions relating to the indicated air temperature.

Engine controls 22 may remain in cold-start mode and continue executing the cold-start algorithm at least until controller 86 determines that the engine speed has reached an idle speed. (step 116) The idle speed may have a fixed value, such as 600 RPM, or the idle speed may be defined as a function of various factors, such as the signal from engine temperature sensor 90, the signal from air temperature sensor 94, and/or the signal from throttle input 98. When controller 86 determines that the engine speed has reached the idle speed, controller 86 may cause starter 20 to discontinue driving power-transfer linkage 16 and working members 14, 15. (step 118 (FIG. 4B))

Controller 86 may then determine whether to continue operating in cold-start mode for a transition period. (step 120) Controller 86 may base the determination of whether to continue operating in cold-start mode for a transition period upon various factors that affect whether it may be beneficial to continue controlling engine 10 in such a manner to compensate for cold conditions. These factors may include the signal from engine temperature sensor 90, the signal from air temperature sensor 94, inputs from various other sensors, inputs from various other controllers, and/or inputs from an operator.

If controller 86 determines to continue operating engine controls 22 in cold-start mode for a transition period, controller 86 may determine how to proceed during the transition period based on the definition of the control reference temperature prior to the transition period. (step 122) If the control reference temperature is defined to be the air temperature indicated by air temperature sensor 94, controller 86 may start a transition timer. (step 124) Controller 86 may then redefine the control reference temperature to be a function of the air temperature, the engine temperature, and at least one other variable, such as time. For example, controller 86 may redefine the control reference temperature as follows (step 126):

$$\text{Cntrl Ref Temp} = \frac{\left(\begin{array}{c}(\text{Eng Temp}/\text{Timer}) + \\ (\text{Air Temp})(\text{Trans Period} - \text{Timer})\end{array}\right)}{\text{Trans Period}}$$

where Cntrl Ref Temp is the control reference temperature, Eng Temp is the engine temperature indicated by engine temperature sensor 90, Air Temp is the air temperature indicated by air temperature sensor 94, Timer is the period of time that the transition timer has been running, and Trans Period is the transition period. Engine controls 22 may then continue executing the cold-start algorithm for controlling fuel delivery as a function of the control reference temperature, as newly defined, and the engine speed (step 128), until the transition timer has been active for the transition period (step 130). The transition period may be a predetermined period having a fixed value, such as five minutes, or the transition period may be determined as a function of various factors, such as various operating conditions of engine 10.

By defining the control reference temperature as set forth above, controller 86 may change the relative significance of the air temperature and the engine temperature as factors in control of fuel delivery over the course of the transition period. When the transition period begins, the control reference temperature will be equal to the air temperature and the engine temperature will have no significance in the control of fuel delivery. As the transition period progresses, the control reference temperature will gradually shift from being equal to the air temperature to being equal to the engine temperature. This gradually increases the significance of the engine temperature as a factor in controlling fuel delivery while gradually decreasing the significance of the air temperature as a factor in controlling fuel delivery.

Once the transition period expires (step 130 (FIG. 4B)), controller 86 may cause engine controls 22 to leave cold-start mode and enter a run mode (step 132 (FIG. 4C)). In the run mode, the control reference temperature may be defined to be the engine temperature (step 134), and controller 86 may cause engine controls 22 to execute a run-mode algorithm for controlling fuel delivery as a function of the control reference temperature and the engine speed (step 136). As with the cold-start algorithm, the run-mode algorithm may include controlling fuel delivery as a function of various other factors in addition to the control reference temperature and the engine speed. However, when operating in run mode, controller 86 may cause engine controls 22 to control fuel delivery without need to compensate for cold conditions to promote successful combustion. Accordingly, controller 86 may cause engine controls 22 to control fuel delivery exclusively to meet other objectives, such as maximizing power, maximizing fuel economy, minimizing emissions, and/or minimizing noise, vibration, and harshness. Controller 86 may maintain engine controls 22 in run mode until controller 86 determines to discontinue power production by engine 10 (step 138), at which time controller 86 may cause engine controls 22 to discontinue delivery of fuel to combustion chambers 26, 27 (step 140).

Returning to FIG. 4B, if the control reference temperature is already defined to be the engine temperature (step 122) when controller 86 determines to remain in the cold-start mode for the transition period (step 120), controller 86 may start the transition timer (step 142 (FIG. 4D)), without redefining the control reference temperature. Controller 86 may then cause engine controls 22 to execute the cold-start algorithm for controlling fuel delivery as a function of the control reference temperature and engine speed (step 144) until the transition timer has run for the transition period (step 146). Once the transition period has expired, controller 86 may cause engine controls 22 to enter the run mode (step 132 (FIG. 4C)) and proceed as described above.

Returning to FIG. 4A, if the controller 86 determines that the engine temperature is not less than the reference engine temperature (step 100 (FIG. 4A)) and controller 86 determines that the engine temperature does not exceed the air temperature by the reference temperature differential (step 106) or that the air temperature is not less than the reference air temperature (step 108), controller 86 may cause engine controls 22 to be in a warm start mode (step 148). In warm start mode, controller 86 may define the control reference temperature to be the engine temperature. (step 150) Controller 86 may then cause starter 20 to drive power-transfer linkage 16 and working members 14, 15 (step 152) while executing a warm start algorithm for controlling fuel delivery as a function of the control reference temperature and engine speed (step 154) until the engine speed is equal to an idle speed. As when operating in run mode, when operating in warm start mode, engine controls may control fuel delivery without need to compensate for cold temperatures and may, thus, control fuel delivery to meet various other objectives. Once engine speed reaches idle speed (step 156), controller 86 may enter run mode (step 132 (FIG. 4C)) and proceed as described above.

Methods according to which engine controls 22 may operate engine 10 are not limited to the embodiments discussed above in connection with FIGS. 4A-4D. Engine controls 22 may execute the actions shown in FIGS. 4A-4D in different orders. Additionally, engine controls 22 may omit one or more of the actions shown in FIGS. 4A-4D and/or execute actions not shown in FIGS. 4A-4D. For example, engine controls 22 may utilize additional criteria and/or omit some of the criteria shown in FIGS. 4A-4D when determining the appropriate operating mode and/or definition of the control reference temperature. In some embodiments, such as embodiments where air temperature sensor 94 senses the temperature of air downstream of turbocharger 48 or another device that alters the temperature of the air, controller 86 may check for a different relationship between the indicated engine temperature and the indicated engine temperature at step 106.

Figure 5:
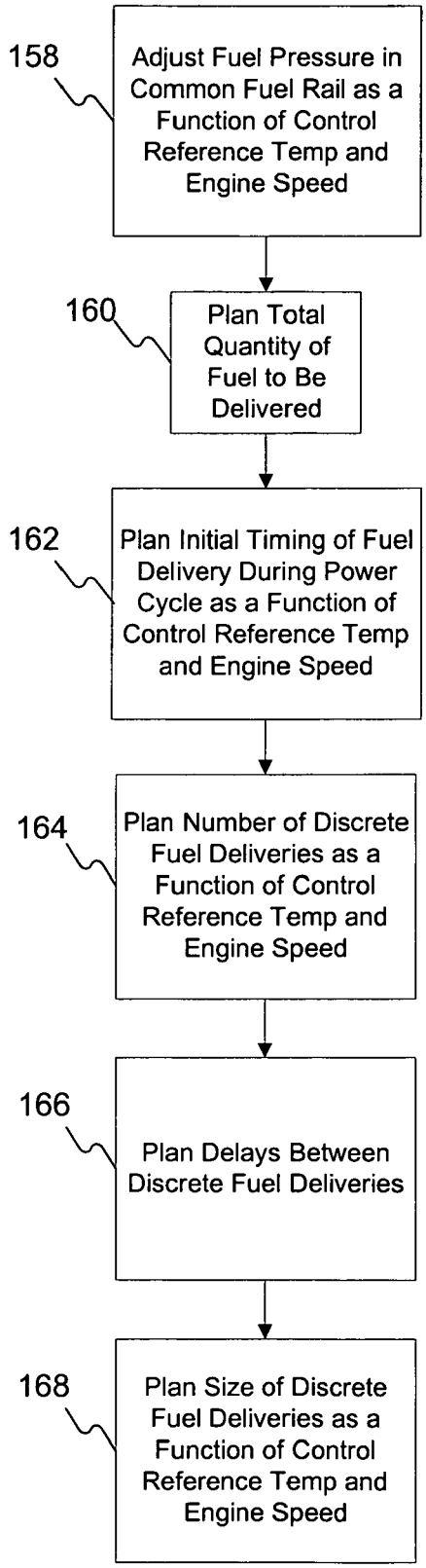
FIG. 5 is a flow chart illustrating a method of executing one of the steps shown in FIG. 4A according to one disclosed embodiment.

FIG. 5 shows one embodiment of a cold-start algorithm that controller 86 may implement when executing steps 114, 128, and 144 of the methods described above in connection with FIGS. 4A-4D. Controller 86 may execute all of the actions shown in FIG. 5 for each combustion chamber 26, 27 during each power cycle. Controller 86 may adjust the fuel pressure in common fuel rail 87 as a function of the control reference temperature and the engine speed. (step 158) Controller 86 may adjust the fuel pressure in common fuel rail 87 through control of fuel pump 76. In some embodiments, lower fuel pressures in common fuel rail 87 may help compensate for cold conditions in combustion chambers 26, 27 and promote successful combustion. Accordingly, the cold-start algorithm may be such that, the lower the control reference temperature and engine speed are, the lower controller 86 may adjust the fuel pressure in common fuel rail 87.

Controller 86 may also plan the total quantity of fuel to be delivered to the combustion chamber 26, 27. (step 160) In some embodiments, controller 86 may plan the total quantity of fuel to be delivered primarily to meet power production and engine speed goals. Controller 86 may plan the total quantity of fuel to be delivered based on various factors, including inputs from throttle input 98, speed/position sensor 88, engine temperature sensor 90, air temperature sensor 94, and/or various other sensors, controllers, or systems.

After planning the total quantity of fuel to be delivered to the combustion chamber 26, 27, controller 86 may determine a manner of delivering that fuel to the combustion chamber to compensate for cold conditions therein and promote successful combustion. Controller 86 may determine the initial timing of fuel delivery into the combustion chamber 26, 27 as a function of the control reference temperature and the engine speed. (step 162) In some embodiments, the lower the control reference temperature and the engine speed are, the earlier controller 86 may make the initial timing of fuel delivery.

After planning the initial timing of fuel delivery, controller 86 may plan the time pattern of delivery for the fuel. Controller 86 may plan the number of discrete fuel deliveries to be made into the combustion chamber 26, 27 as a function of the control reference temperature and the engine speed. (step 164) For example, controller 86 may plan whether to make any preliminary fuel deliveries into the combustion chamber prior to a primary fuel delivery and, if so, how many preliminary fuel deliveries to make. In some embodiments, the lower the control reference temperature and engine speed are, the more preliminary fuel deliveries controller 86 may plan. Controller 86 may also plan the delays between the discrete fuel deliveries. (step 166) Controller 86 may plan the delays between the discrete fuel deliveries to make the overall delivery of fuel into the combustion chamber 26, 27 during the power cycle relatively gradual. Controller 86 may also plan the size of each discrete fuel delivery as a function of the control reference temperature and the engine speed. (step 168) In some embodiments, controller 86 may plan the first preliminary fuel delivery to be the smallest, the primary fuel delivery to be the largest, and each fuel delivery between to be progressively larger than the previous. Additionally, in some embodiments, the lower the control reference temperature and engine speed are, the larger the planned progression in size from the first preliminary fuel delivery to the primary fuel delivery will be.

Thus, as discussed above, when executing the cold-start algorithm, for lower control reference temperatures and lower engine speeds, controller 86 may make the initial timing of fuel delivery earlier and the time pattern of fuel delivery more gradual and progressive. In embodiments where engine 10 is a compression-ignition engine, this may help compensate for low temperatures and slow engine speed to promote successful combustion by gradually raising the temperature and pressure in the combustion chamber 26, 27 through a gradual, progressive process of combustion in the combustion chamber 26, 27. Such a cold-start algorithm may also be beneficially employed in embodiments where engine 10 is a type of engine other than a compression-ignition engine.

Cold-start algorithms according to which engine controls 22 may control engine 10 are not limited to the embodiments discussed above in connection with FIG. 5. For example, rather than defining the time pattern of fuel delivery exclusively by defining the number, size, and relative timing of discrete fuel deliveries, engine controls 22 may define the time pattern of fuel delivery at least partially by defining the manner in which the rate of fuel delivery varies during one or more discrete fuel deliveries. Additionally, in some embodiments, such as embodiments where engine 10 is a spark-ignition engine, the cold-start algorithm may involve controlling the quantity of fuel delivered in such a manner to compensate for cold conditions, rather than controlling the initial timing and time pattern of fuel delivery.

The disclosed embodiments may help ensure desirable operation of engine 10 in various circumstances. Operating in cold-start mode when the air temperature is relatively low may help compensate for the relatively low temperature of air delivered to combustion chambers 26, 27 to promote successful combustion. Additionally, when the air temperature is relatively low, controlling fuel delivery at least partially as a function of the air temperature may help ensure that fuel delivery is adjusted to a proper degree to compensate for the cold air. Furthermore, comparing the indicated engine temperature and the indicated air temperature may help identify circumstances wherein the indicated engine temperature alone may not be a good indicator of conditions in combustion chambers 26, 27. In such circumstances, operating in cold-start mode in response to cold air temperature and controlling fuel delivery at least partially as a function of the air temperature may be particularly beneficial.

Changing the relative significance of the signal from engine temperature sensor 90 and air temperature sensor 94 as factors in controlling fuel delivery may also help maintain desirable operation of engine 10 in varying operating circumstances. For example, increasing the relative significance of the signal from engine temperature sensor 90 after starting engine 10 producing power may help engine controls 22 adjust fuel delivery to capitalize on certain changes that occur with increasing runtime of engine 10 As the runtime of engine 10 increases, heat from combustion in combustion chambers 26, 27 may gradually increase the temperatures of combustion chamber surfaces 47, 49. As the temperatures of combustion chamber surfaces 47, 49 change, engine controls 22 may achieve various desirable results by adjusting fuel delivery in response to those changes. For example, as these temperatures increase, conditions in combustion chambers 26, 27 may become more conducive to combustion, and engine controls 22 may decrease measures intended to compensate for cold conditions and increase measures intended to promote other objectives, such as maximizing power production, maximizing fuel economy, minimizing undesirable emissions, and/or minimizing noise, vibration, and harshness.

Additionally, as the runtime of engine 10 increases, the signal from engine temperature sensor 90 may become an increasingly reliable source of information about the temperatures of combustion chamber surfaces 47, 49. As mentioned above, when engine controls 22 start engine 10 producing power, engine temperature sensor 90 may be receiving heat in unknown amounts from various sources, such as the atmosphere, engine heater 21, and/or residual heat in components of engine 10 from prior power production. After engine 10 starts producing power, heat from combustion may become an increasingly large percentage of the heat that reaches engine temperature sensor 90. As this occurs, the relationship between the temperatures of combustion chamber surfaces 47, 49 and the signal generated by engine temperature sensor 90 may become more predictable. As a result, as runtime increases, engine controls 22 may appropriately adjust for increasing temperatures of combustion chamber surfaces 47, 49 by increasing the significance of the signal from engine temperature sensor 90 as a factor in controlling fuel delivery and, thereby, achieve significant performance advantages. Gradually changing the relative significance of the engine temperature and the air temperature may help ensure that fuel delivery is adjusted at an appropriate rate as combustion chamber surfaces 47, 49 gradually warm up and also that any resulting changes in speed, noise, or power production occur smoothly.

It will be apparent to those skilled in the art that various modifications and variations can be made in the disclosed engine and operating methods without departing from the scope of the disclosure. Other embodiments of the disclosed engine and operating methods will be apparent to those skilled in the art from consideration of the specification and practice of the engine and operating methods disclosed herein. It is intended that the specification and examples be considered as exemplary only, with a true scope of the disclosure being indicated by the following claims and their equivalents.

What is claimed is:

1. A method of operating an engine, the engine having a combustion chamber, a working member positioned adjacent the combustion chamber, and engine controls, the method comprising:

providing a source of fuel for the engine;

starting the engine producing power by combusting fuel in the combustion chamber to drive the working member;

controlling fuel delivery to the combustion chamber with the engine controls, including selectively controlling delivery of the fuel to the combustion chamber at least partially as a function of an air temperature in response to achieving at least one predetermined condition involving the air temperature and, in at least some circumstances, changing with the engine controls the relative significance of the air temperature and an engine temperature as factors in controlling fuel delivery to the combustion chamber, wherein the air temperature is at least one of an ambient air temperature and an intake air temperature.

2. The method of claim 1, wherein the at least one predetermined condition involving the air temperature includes the air temperature being below a reference temperature.

3. The method of claim 2, wherein the at least one predetermined condition involving the air temperature includes existence of a predetermined relationship between an engine temperature and the air temperature.

4. The method of claim 2, wherein controlling the delivery of the fuel to the combustion chamber at least partially as a function of the air temperature includes controlling the delivery of the fuel to the combustion chamber in such a manner to compensate for cold conditions to promote successful combustion.

5. The method of claim 1, wherein the at least one predetermined condition involving the air temperature includes existence of a predetermined relationship between an engine temperature and the air temperature.

6. The method of claim 1, wherein the circumstances of changing with the engine controls the relative significance of the air temperature and an engine temperature as factors in controlling fuel delivery to the combustion chamber include changing with the engine controls the relative significance of the air temperature and an engine temperature as factors in controlling fuel delivery to the combustion chamber subsequent to starting the engine producing power.

7. The method of claim 6, wherein changing with the engine controls the relative significance of the air temperature and the engine temperature as factors in controlling the delivery of the fuel to the combustion chamber subsequent to starting the engine producing power includes increasing the relative significance of the engine temperature.

8. The method of claim 1, wherein:

the air temperature is the ambient air temperature; and controlling the delivery of the fuel to the combustion chamber at least partially as a function of the air temperature is done only in response to achieving the at least one predetermined condition involving the air temperature, the at least one predetermined condition involving the air temperature including the air temperature being below a predetermined reference temperature and a predetermined relationship between the air temperature and an engine temperature.

9. An engine, comprising:

a combustion chamber;

a working member positioned adjacent the combustion chamber;

engine controls operable to cause the engine to produce power by combusting fuel in the combustion chamber to drive the working member;

the engine controls being operable to, when starting the engine and before the engine has reached an idle speed, in response to achieving at least one first predetermined condition involving an air temperature, execute a cold-start algorithm for controlling fuel delivery to the combustion chamber;

wherein the air temperature is at least one of an ambient air temperature and an intake air temperature; and wherein executing the cold-start algorithm for controlling fuel delivery to the combustion chamber includes delivering fuel to the combustion chamber in a manner to compensate for cold conditions and promote successful combustion.

10. The engine of claim 9, wherein the at least one first predetermined condition includes the air temperature having a predetermined relationship to the engine temperature.

11. The engine of claim 9, wherein the engine controls are further configured to, when starting the engine, in response to achieving the at least one first predetermined condition, control fuel delivery to the combustion chamber at least partially as a function of the air temperature.

12. The engine of claim 9, wherein: the engine is a compression ignition engine utilizing heat and pressure generated by the working member compressing air in the combustion chamber to initiate combustion of fuel in the combustion chamber; and executing the cold-start algorithm for controlling fuel delivery to the combustion chamber includes controlling an initial timing and a time pattern of fuel delivery into the combustion chamber during each power cycle in a manner to compensate for cold conditions and promote successful combustion.

13. The engine of claim 9, wherein the engine controls are further operable to, when starting the engine, in response to achieving at least one second predetermined condition that includes an engine temperature being below a reference engine temperature, execute the cold-start algorithm for controlling fuel delivery to the combustion chamber.

14. An engine, comprising:

a combustion chamber;

a working member positioned adjacent the combustion chamber;

engine controls operable to cause the engine to produce power by combusting fuel with air in the combustion chamber to drive the working member;

the engine controls being further operable to in at least some circumstances, control fuel delivery to the combustion chamber at least partially as a function of an air temperature, the air temperature being at least one of an ambient air temperature and an intake air temperature, in at least some circumstances, control fuel delivery to the combustion chamber at least partially as a function of an engine temperature, and while causing the engine to produce power, change the relative significance of the air temperature and the engine temperature as factors in controlling fuel delivery to the combustion chamber.

15. The engine of claim 14, wherein:

controlling fuel delivery to the combustion chamber at least partially as a function of the air temperature includes, in at least some circumstances, controlling fuel delivery to the combustion chamber at least partially as a function of the air temperature when starting the engine producing power; and changing the relative significance of the air temperature and the engine temperature as factors in controlling fuel delivery to the combustion chamber includes, subsequent to starting the engine producing power, increasing the significance of the engine temperature with respect to the significance of the air temperature.

16. The engine of claim 14, wherein controlling fuel delivery to the combustion chamber at least partially as a function of the air temperature in at least some circumstances includes selectively controlling fuel delivery to the combustion at least partially as a function of the air temperature when starting the engine producing power.

17. The engine of claim 16, wherein changing the relative significance of the air temperature and the engine temperature as factors in controlling fuel delivery to the combustion chamber includes subsequent to controlling fuel delivery to the combustion chamber at least partially as a function of the air temperature when starting the engine producing power, gradually phasing out the air temperature as a factor in control of fuel delivery to the combustion chamber while gradually increasing the significance of the engine temperature as a factor in control of fuel delivery to the combustion chamber.

18. The engine of claim 14, wherein controlling fuel delivery to the combustion chamber at least partially as a function of the air temperature in at least some circumstances includes when starting the engine producing power, in response to at least one predetermined condition that includes an engine temperature having a predetermined relationship to the air temperature, controlling fuel delivery to the combustion chamber at least partially as a function of the air temperature.

19. The engine of claim 14, wherein controlling fuel delivery to the combustion chamber at least partially as a function of the air temperature in at least some circumstances includes when starting the engine producing power, in response to achieving at least one predetermined condition that includes the engine temperature having a predetermined relationship to the air temperature, controlling fuel delivery to the combustion chamber at least partially as a function of the air temperature.

* * * * *